United States Patent [19]

Alape

[11] 4,294,779

[45] Oct. 13, 1981

[54] CARBURETOR DEVICE

[75] Inventor: William J. Alape, Springfield, N.J.

[73] Assignee: Aquascooter Inc., Springfield, N.J.

[21] Appl. No.: 178,061

[22] Filed: Aug. 14, 1980

[51] Int. Cl.[3] ..... F02M 17/04

[52] U.S. Cl. ..... 261/35; 261/DIG. 68; 114/337

[58] Field of Search ..... 261/DIG. 68, 35; 114/337

[56] References Cited

U.S. PATENT DOCUMENTS

| | | | |
|---|---|---|---|
| 3,174,732 | 3/1965 | Brown | 261/DIG. 68 |
| 3,236,505 | 2/1966 | Phillips | 261/DIG. 68 |
| 3,441,010 | 4/1969 | Barr et al. | 261/DIG. 68 |
| 4,160,425 | 7/1979 | Curtis | 261/DIG. 68 |
| 4,230,646 | 10/1980 | Ghizzoni | 261/DIG. 68 |

*Primary Examiner*—Tim R. Miles

*Attorney, Agent, or Firm*—Sprung, Felfe, Horn, Lynch & Kramer

[57] ABSTRACT

In a compensating membrane carburetor having a fuel accumulating chamber connected through idling and high-speed jets to a Venturi, a compensating chamber is provided which is maintained, naturally or artificially, at atmospheric pressure. A second chamber seals the external face of the compensating membrane from the environment of the carburetor and a first relief line, partially disposed in the carburetor, provides fluid communication between the compensating chamber and the second chamber to maintain the second chamber at atmospheric pressure. A second relief line is disposed substantially outside of the carburetor and also provides fluid communication between the compensating chamber and the second chamber, in order to insure the proper operation of the carburetor in the event of a blockage in one of the two lines.

8 Claims, 1 Drawing Figure

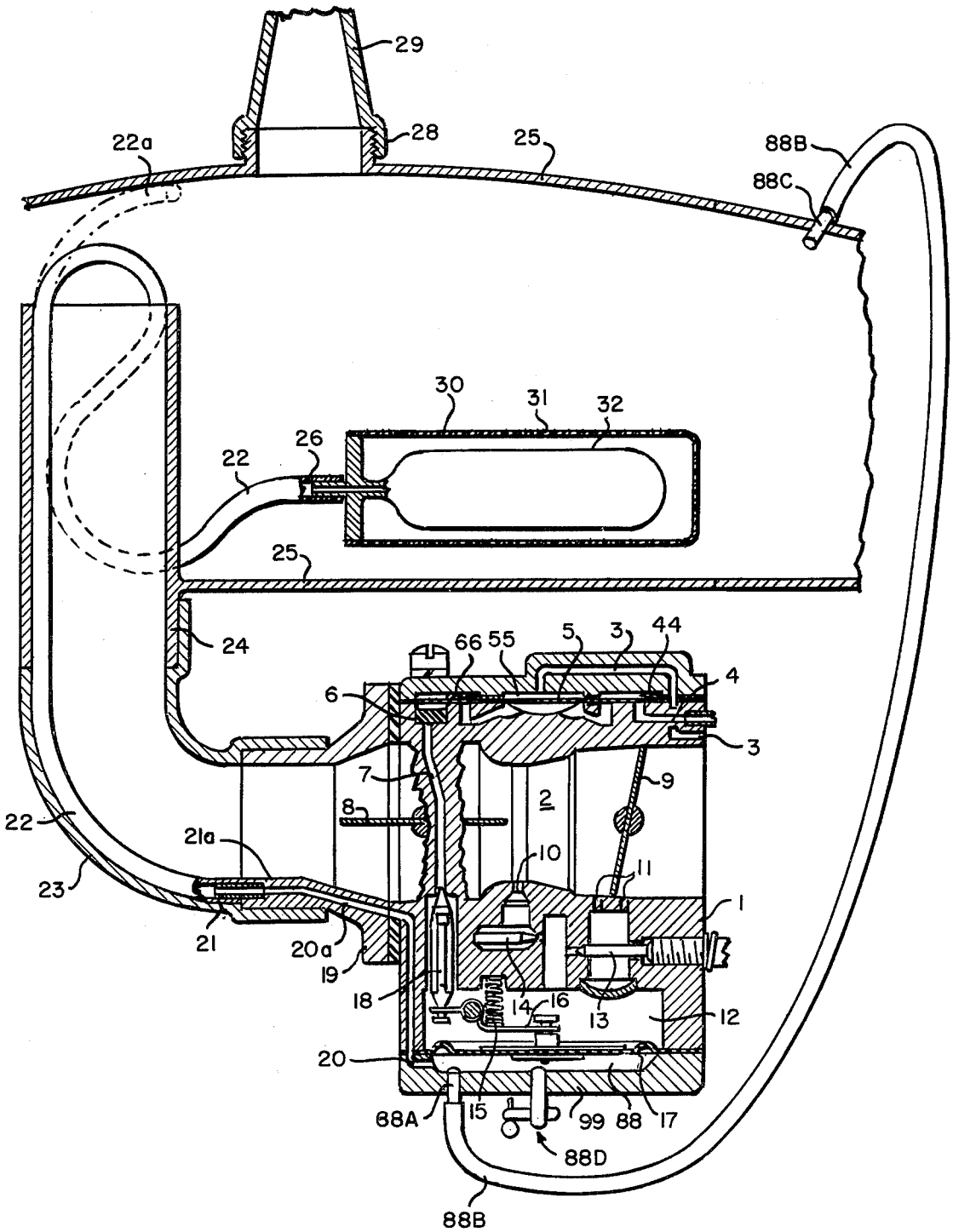
29
28
22a
25
88B
88C
30
31
32
26
22
25
24
66
55
5
3
44
4
6
3
7
9
2
8
22
21a
10
11
23
1
21
20a
19
18
14
16
13
12
20
68A
15
99
88
17
88D
88B

CARBURETOR DEVICE

BACKGROUND

The invention relates generally to carburetors, and more particularly to carburetors of the membrane type.

It is known that carburetors of the membrane type, unlike other types of carburetor, were designed for the purpose of assuring correct operation or the optimum fueling of an internal combustion engine, even when the engine is used in positions ranging from its proper horizontal position to the inverted position.

The membrane carburetors referred to above are used particularly in portable chain saws and in outboard motors on any kind of boats, and in general in all cases in which the internal combustion engine is mounted on machines, devices and equipment which, on account of their particular use, are subjected to constant rocking, tilting or shifting of position. In brief, the membrane carburetors of the known type are essentially provided centrally with a Venturi tube through which air passes to constitute the combustible mixture, and within which the high-speed and idle jets terminate. These jets are connected by appropriate passages, with the interposition of suitable regulating screws, to a fuel accumulating chamber which is supplied by a conventional diaphragm pump. One surface of said diaphragm pump is in contact with the fuel which is drawn from the fuel tank, while the opposite surface faces a chamber which receives the drive pulses from the crank-case of the internal combustion engine.

Furthermore, for the proper operation of the motor, the outside wall of the fuel accumulating chamber is defined by a thin membrane which is connected, through the medium of a suitable rocker arm, to the needle valve which is interposed between the diaphragm pump and the above-mentioned fuel accumulating chamber.

Lastly, the surface of the said membrane which is external to the fuel accumulating chamber is directly in contact with the atmosphere so as to operate at atmospheric pressure, and it is for this reason that this membrane is often called the "compensating membrane."

Although the membrane carburetors of the type treated above, and thus structured and designed, have proven and still prove to be suitable for the uses for which they are intended, they have serious deficiencies, particularly when they must operate under adverse conditions, and more particularly when they are partially or completely submerged in a liquid, which can be, for example, water. In fact, if the internal combustion engine is to operate partially or completely submerged, as for example in the case of a means of propulsion for an underwater exploration or working machine, in the case of a chain saw to be used in cutting up tree trunks obstructing the banks of a river, in the case, which is often encountered, of operation in a heavy downpour of rain, in the case of outboard motors in general, in the case of a traction and transport means for an underwater explorer or SCUBA diver, and in all cases in which it is required, the compensating action of the carburetor membrane will fail because there is added to the atmospheric pressure, which is optimum for the proper operation of the carburetor, the hydrostatic head, which is defined by the difference in altitude between the free surface of the fresh or salt water or other liquid and the depth reached in this liquid by the said compensating membrane.

The difficulties cited above result, of course, in the complete stoppage of the engine, with the consequences resulting particularly if the internal combustion engine is a propulsion means for an underwater exploration or working machine, or if it is an outboard motor in a boat which is at sea under particularly adverse conditions.

Furthermore, the above-cited difficulties are worsened by the fact that the compensating action of the membrane is further impaired by the relative movements which take place between the liquid and the membrane due to the movement of the internal combustion engine relative to the liquid, or on account of the movement of the said liquid with respect to the virtually stationary engine; that is to say, in this case, there is added to the atmospheric pressure a hydrodynamic head which, of course, is greater than the hydrostatic head. Furthermore, these difficulties become much more evident in the case of liquids of greater specific gravity, such as salt water or muddy water, industrial liquids or industrial waste liquids which, in comparison with fresh water, present a hydrostatic or hydrodynamic head that is certainly greater than that of fresh water.

In view of what is said above, it certainly is not necessary to direct attention to all the consequences which result from the above-stated difficulties and which result in the stoppage of the internal combustion engine.

In a pending application, Ser. No. 002,041 filed Jan. 5, 1979, now U.S. Pat. No. 4,230,646, a device is disclosed particularly adapted for carburetors of the compensating membrane type for eliminating the difficulties cited above and assuring the proper operation of the internal combustion engine even when the latter is partially or completely immersed in any liquid, particularly water.

The basic concept of that device is to provide a compensating air bag or chamber, connected to a conventional compensating membrane of the carburetor, which will be disposed inside of the internal combustion engine or externally thereof, so as to be reliably influenced only by the atmospheric pressure, maintained in a natural or artificial manner, which is the optimum pressure for the correct operation of the internal combustion engine.

It has been found, however, if atmospheric pressure is not freely communicated to the atmospheric side of the compensating membrane, that is to say if there is any blockage such as any liquid or solid of sufficient quantity and quality to restrict the free flow of compensating atmospheric pressure within any part of the chamber formed around the compensating membrane, it will lose its ability to compensate for the varying pressures on the fuel side thereof and thereby will cause the inlet control needle of the carburetor to open and close out of harmony with the demands of the engine. This situation, depending on the degree of blockage, will cause the engine performance to deviate from normal in degrees from erratic loss of power due to slightly more fuel flow than what is required, to complete engine shutdown due to, most often, a profuse fuel flow and subsequent flooding or conversely a stoppage of fuel flow.

If the above-mentioned blockage occurs, the remedy, in most cases, involves removal, partial disassembly, reassembly, reinstallation and pressure testing the carburetor and its appendages. This procedure requires diagnosis and some degree of technical ability, as well as some special tools.

SUMMARY OF THE INVENTION

It is therefore an object of the present invention to improve on the known device by eliminating the disadvantages thereof, as noted above.

These and other advantages, as will be explained hereinafter, are achieved by the structure of the present invention and include providing a second atmospheric relief from and through the chamber which seals the external face of the compensating membrane to the compensating chamber, which is maintained at atmospheric pressure in a natural or artificial manner.

The access to the compensating membrane chamber is preferably at or near its lowest point, and is preferably connected to the top rear portion of the engine air tank via a tube.

The advantage of a dual atmospheric relief system, as defined above, is that if one relief outlet becomes blocked or restricted, the other will prevail. Moreover, a complete circuit will exist whereby, if both systems, become restricted or blocked, it can be remedied by simply removing the relief tube at its connection between the air tank and the compensating membrane chamber and by blowing with lung pressure into the tube to purge same of the blockage. This procedure requires no special tools and can be done at the scene of the use of the engine.

Furthermore, the placement of the connection of the tube at the rear part of the air tank puts it far enough away from the air flow, from and between the air intake connection and the riser therein, so as to ensure that it communicates the most uniform pressure within the air tank at all engine speeds to the compensating membrane chamber, and thus provides the engine with proper fuel flow at all speeds.

Placing the connection at the top rear section of the air tank also lessens the possibility of any water entering this connection during the process of dumping any water that frequently enters into the air tank when, for example, the operator submerges the top opening of the inlet tube to the air tank under water, when the engine is utilized in a water-submergible engine.

A variation of the double atmospheric relief-purgation system is retention of the present relief system and the addition of a valve through the external cover of the compensating chamber, preferably at or near the lowest point when the engine is in an upright position, so as to provide a fast and easy method of removing any liquid or semi-liquid that may enter the atmospheric relief system simply by opening the valve and with light lung pressure blowing through the snorkel.

A BRIEF DESCRIPTION OF THE DRAWING

Additional advantages of the invention, together with their operating features and their features of construction will be further clarified and set forth in the detailed description that follows, which refers to the appended drawing illustrating a particular and preferred embodiment, given, however, only by way of non-limitative example.

DETAILED DESCRIPTION OF THE INVENTION

The drawing is a cross-sectional view on different levels of a conventional compensating membrane carburetor equipped with a device in accordance with the present invention. A membrane-type carburetor which is essentially composed of a body 1 has a cavity 2 defining a Venturi tube. Above the Venturi tube 2, there is provided a conduit 3 which is connected to a fuel pump working chamber 55. In addition, in the same upper portion of the body 1 there is provided a fuel inlet passage 4 which is also connected to the working chamber 55 through a resilient valve 44. In the drawing it can be seen that the working chamber 55 is separated into two opposite compartments by a diaphragm 5, the upper side of which faces the conduit 3 and the other side faces the fuel inlet passage 4. Downstream from the working chamber 55, along the fuel inlet passage 4, there is inserted a second resilient valve 66, downstream from which there is provided a fuel pumping passage 7 which is connected to the inlet passage 4 through a filter 6. At the lower terminal portion of the fuel pumping passage 7 there is a needle valve 18 constituting a shut-off means between the fuel pumping passage 7 and a fuel accumulating chamber 12 which is created in the lower portion of body 1. The bottom end of the needle valve 18 is engaged by the left extremity of a rocker 16 pivoted on a pin contained in the fuel accumulating chamber 12, the opposite end of the rocker being connected to a balancing membrane 17 which defines the bottom wall of the accumulating chamber 12. Furthermore, between the left arm of the rocker 16 and the body 1 there is inserted a compression spring 15. By means of appropriate passages, the fuel accumulating chamber 12 is connected to a high-speed jet 10 and to a pair of idle jets 11.

As shown in the drawing, adjusting needles 13 and 14 are provided for the idle jets 11 and for the high-speed jet 10, respectively. Upstream from the high-speed jet 10, with respect to the direction of flow of the air within the Venturi tube 2, there is provided a choke valve 8. Just downstream from the idle jets, a throttle valve 9 is provided in the Venturi tube 2.

To the bottom of body 1, externally of the membrane 17, there is affixed a plate 99 defining a pressure chamber 88. At the left side of the plate 99, which is opposite the upstream zone of the Venturi tube 2, there is provided a passage 20 which is part of a first relief system and which is connected to another passage which is present in the flange 19 which is clamped against the left wall of the body 1. The passage **20*a* is created within the thickened portion 21*a* provided on the internal surface of the flange 19. To the free end of the flange 19 there is attached the air intake manifold 23, of a substantially elbow shape, which is connected at its opposite end to the riser 24 of the tank 25. A tube of brass 21 is force-fitted or hermetically sealed to the free end of the passage 20*a*, and a rubber tube 22 is fitted to its free end and adheres to the inside surface of the air intake manifold 23**.

The riser 24 of the air tank 25 penetrates into the interior of the latter until its upper end is almost reached, where it is offset from the connection 28. The latter, which is threaded externally, is provided for the attachment of a tube 29.

The rubber tube 22 passes all the way through the riser 24 and exits from its upper extremity and can be fixed to or fall freely about the interior of the air tank 25. This embodiment is shown in dotted lines where the free end of tube 22 simply communicates with the interior of tank 25 which acts via tube 22 as the compensating chamber for diaphragm 17.

In another embodiment, tube 22 has a fitting 26 whose extremity penetrates to the interior of a containing cage or screen 30. The latter has a substantially cylindrical shape, and its surface, and its bottom as well, is provided with a plurality of apertures 31. The free end of the brass tube 26 is connected sealingly to a compensating air bag 32. This compensating air bag 32 is substantially sack-shaped and is made from an elastomer whose specific weight is at least lower than that of fresh water.

The extremely thin walls of the compensating air bag 32 have high qualities of flexibility and resilience and they have great resistance to atmospheric agents and to corrosive agents such as sea salts.

Furthermore, the cage 30 also has a specific weight that is lower at least than that of fresh water.

A second atmospheric relief system comprises means connecting the chamber 88 with the tank 25. This means preferably comprises a fitting 88A passing through the plate 99 and in communication with chamber 88, and a fitting 88C in tank 25 and in communication with the air therein. The two fittings, 88A and 88C, are connected by tube 88B, which thereby provides communication between tank 25 and chamber 88.

The means connecting the chamber 88 with the tank 25 preferably utilizes the fittings 88A and 88C or similar fittings, so that if there is a blockage in either atmosphere relief system, it can be merely removed from the fittings 88A and 88C and purged by blowing with lung pressure therethrough, and thereafter, easily replaced.

It is, furthermore, preferable to place the fitting 88C at the rear of the tank 25, so as to put it far enough away from the air flow, from and between the air intake connection 28 and the riser 24, so as to insure that it communicates the most uniform pressure within the air tank 25 at all engine speeds to the chamber 88, and thus provide the engine with the proper fuel flow at all speeds.

Further, it is preferable to place the fitting 88C at the top rear section of the air tank 25, to lessen the possibility of any water entering through fitting 88C during the process of dumping any water that frequently enters into the air tank 25 through the air tube 29 when an operator submerges the top opening of the tube 29 under the water when the invention is used in a submergible engine.

An alternative to the connections via tube 88B is the addition of valve 88D passing thru plate 99 to provide a means of removing any blockage simply by opening valve 88D and with light lung pressure blowing into tube 29.

The invention explained above operates as follows.

Although technicians of the art, are all familiar with it, a brief description will be given of the operation of the compensating membrane carburetor under normal conditions in conjunction with an internal combustion engine.

As known in the prior art, the fuel passes through the inlet passage 4 into the lower part of the working chamber 55 by virtue of the pumping action of the diaphragm 5. This diaphragm 5 operates as a pump by receiving pulsations through a conduit 3 which is connected to the crankcase of the internal combustion engine. Each time that the diaphragm 5 is raised up in its central area, it creates a vacuum within the fuel inlet passage 4, whereby the resilient valve 66 closes against its seat while the resilient valve 44 is raised upwardly when the fuel is drawn from the tank. But when the diaphragm 5 moves downward, the fuel present in the working chamber 55 is placed under pressure causing the resilient valve 44 to close and the resilient valve 66 to open, resulting in the transfer of the fuel to the delivery conduit 7. Obviously, during its operation, the internal combustion engine draws in air through the Venturi 2 so as to create a depression which is induced or transmitted to the accumulating chamber 12. This depression again raises the membrane 17 which in turn, by means of the rocker 16, lowers the needle 18, thus enabling the fuel present in the delivery conduit 7 to flow into the fuel accumulating chamber 12.

Since there is a passage of air through the Venturi tube 2, then, assuming that at this moment the internal combustion engine is idling, this air creates a vacuum within the fuel accumulating chamber 12 whereby the fuel is drawn to the interior of the Venturi tube 2 through the idle jets 11 so as to constitute, together with the air, the combustion mixture for the internal combustion engine. Now, with regard to the device proposed by the present invention, the dual atmospheric relief system ensures that the chamber 88 has therewithin the atmospheric pressure necessary for the proper operation of the internal combustion engine. The chamber 88, through passage 20, passage **20*a* and the tube 22, derives the atmospheric pressure from the air tank 25, which in turn is connected to the atmosphere through the vent 28 and the vent tube 29. If a compensating air bag 32 is used, it is made of a very thin envelope having high characteristics of elasticity and flexibility, so that it permits the detection of the atmospheric pressure inside of the air tank 25 and to transmit the value thereof, virtually unaltered, to the interior of the chamber 88, so that the compensating membrane 17** will be in optimum operating condition.

At the same time, atmospheric pressure is insured in chamber 88 by the connection between chamber 88 and air tank 25 via the connecting means including fittings 88A and 88C and tube 88B. In this way, if one system becomes blocked or restricted, the other will prevail.

At this point it must be stated that, very advantageously, the device proposed by the invention makes it possible to use internal combustion engines in conjunction with a compensating membrane type carburetor in the most various and severe operating conditions, particularly in the presence of fresh or salt water, inasmuch as the membrane 17 does not come in contact with these liquids and, through the proposed device, its exterior surface is maintained under the atmospheric pressure which is detected within the air tank 25. This fact is obviously of great advantage particularly when the internal combustion engine is employed as an outboard motor for any kind of boat, as a means of propulsion for a machine, apparatus or device intended for underwater exploration or working operations, as a means of propulsion for a loading and transporting means for underwater workers or SCUBA divers, as a means of powering a portable power saw which has to be used in locations where moisture, fresh water or salt water or other liquids are present, such as, for example, industrial working liquids and/or waste liquids, and in all cases wherein the said motors must be used under the above-listed adverse conditions of operation.

From the above it is clear that, even when the carburetor is partially or completely immersed in a liquid, its compensating membrane 17 will not be subject to even the least hydrostatic or hydrodynamic head, due to the air tank 25 which is situated in a zone of the motor which is held constantly at atmospheric pressure because it is directly connected to the exterior.

The materials of which the cage 30 and the air bag 32 are made have a specific weight which is less at least than the specific weight of fresh water. Condensed moisture or any water that penetrates to the interior of the air tank 25 will not affect the operation of the membrane carburetor, and hence of the internal combustion engine, inasmuch as the tube 22 with or without elements 30 and 32 floats on any liquid that might be present in the lower part of the tank 25. Once the motor is stopped, any water that may have penetrated into the tank or condensed therein can easily be removed simply by inverting the motor so as to drain it through the vent 28. The cage or strainer 30 can be used to protect the end of tube 22 which can also be fitted with a strainer or water adsorbing material. The cage 30 can function to protect air bag 32 during movements of the motor during operation or dumping out the water present in the tank 25.

Lastly, stressing once again that what is indicated in the drawing is given simply by way of example, it is evident that the compensating air tank 25 can be housed in any type of container within which atmospheric pressure is maintained naturally or artificially. Of course, such housing can be provided not only as part of the motor but also separately therefrom. For example, an additional and appropriate application of the invention can be achieved by attaching the rubber tubes 22 and 88B directly to a lung or expansion valve or chamber connected to an oxygen bottle carried by an underwater worker or SCUBA diver who has to operate a means of propulsion that has to be partially or completely submerged in a liquid, particularly fresh or salt water.

From what has been proposed as an alternative it is evident that the use of the invention in connection with compensating membrane type carburetors can be very diverse particularly as regards the placement of the tubes 22 and 88B as long as they are in an environment in which atmospheric pressure is maintained either naturally or artificially.

It is to be understood that the invention is in no way restricted to the sole embodiment described above, and that variants and improvements can be made therein without departing from the scope of the invention, whose fundamental characteristics are summarized in the claims.

I claim:

1. In a compensating membrane carburetor having a fuel accumulating chamber connected through idling and high-speed jets to a Venturi, the improvement which comprises: compensating chamber means maintained naturally or artificially at atmospheric pressure; second chamber means for sealing the external face of the compensating membrane from the environment of the carburetor; first relief means partially disposed in the carburetor providing fluid communication between the compensating chamber means and the second chamber means to maintain the second chamber means at atmospheric pressure; and second relief means disposed substantially outside of the carburetor for providing a second fluid communication between the compensating chamber means and the second chamber means.

2. The carburetor according to claim 1, wherein the second relief means comprises a tube external of the carburetor and connected between the compensating chamber means and the second chamber means.

3. The carburetor according to claim 2, wherein the second relief means further comprises a fitting on the second chamber means and on the compensating chamber means and wherein the tube is releasably connected to the fittings at both ends thereof.

4. The carburetor according to claim 1, wherein the compensating chamber means comprises an air tank.

5. The carburetor according to claim 4, wherein the second relief means comprises a tube connected to the top of the air tank.

6. The carburetor of claim 1, further comprising an air intake manifold provided upstream of the Venturi and wherein the first relief means comprises flexible tube means mounted in the air intake manifold for the carburetor wherein the manifold communicates with the compensating chamber means.

7. The carburetor of claim 6 further comprising compensating air bag means connected to the free end of the tube means.

8. In a water submergible engine, the improvement comprising the carburetor of claim 1.

* * * * *